US006546914B1

(12) United States Patent
Fath et al.

(10) Patent No.: US 6,546,914 B1
(45) Date of Patent: Apr. 15, 2003

(54) FUEL INJECTION VALVE FOR AN INTERNAL COMBUSTION ENGINE

(75) Inventors: Andreas Fath, Regensburg (DE); Günter Lewentz, Regensburg (DE); Wilhelm Frank, Bamberg (DE); Eberhard Kull, Pfaffenhofen (DE); Hakan Yalcin, Regensburg (DE); Wendelin Klügl, Seubersdorf (DE)

(73) Assignee: Siemens Aktiengesellschaft (DE)

( * ) Notice: Subject to any disclaimer, the term of this patent is extended or adjusted under 35 U.S.C. 154(b) by 0 days.

(21) Appl. No.: 09/555,406

(22) PCT Filed: Sep. 22, 1999

(86) PCT No.: PCT/DE99/03040

§ 371 (c)(1),
(2), (4) Date: Nov. 27, 2000

(87) PCT Pub. No.: WO00/19088

PCT Pub. Date: Apr. 6, 2000

(30) Foreign Application Priority Data

Sep. 29, 1998 (DE) ..... 198 44 638

(51) Int. Cl.[7] ..... F02M 37/04
(52) U.S. Cl. ..... 123/467; 123/300; 239/533.3
(58) Field of Search ..... 123/467, 289, 123/300, 496; 239/533.3–533.12

(56) References Cited

U.S. PATENT DOCUMENTS 2,627,254 A * 2/1953 DeJuhasz ..... 123/467
4,528,951 A 7/1985 Yamada ..... 123/300
5,020,500 A * 6/1991 Kelly ..... 123/467
5,159,911 A * 11/1992 Williams et al. ..... 123/467
5,241,935 A * 9/1993 Beck et al. ..... 123/300

FOREIGN PATENT DOCUMENTS

| | | |
|---|---|---|
| AT | 389 151 B | 10/1989 |
| CH | 372501 | 11/1963 |
| DE | 30 14 958 A1 | 10/1981 |
| DE | 3810467 A1 | 10/1989 |
| DE | 196 34 933 A1 | 3/1998 |
| EP | 0 460 326 A1 | 12/1991 |
| FR | 1 190 361 A | 10/1959 |
| FR | 2 328 855 | 5/1977 |
| FR | 2 383 324 A | 10/1978 |

* cited by examiner

*Primary Examiner*—Carl S. Miller

(57) ABSTRACT

The nozzle body (5) of a fuel injection valve has a central bore (54) in which a nozzle needle (1) is guided. The tip (52) of the nozzle body (5) has a tapered valve seat (55) which forms together with the sealing edge (27) of the nozzle needle (1) a valve (27, 55) which controls the flow of fuel to the injection holes (9) in the nozzle tip (52). Underneath the sealing edge (27) a circumferential groove (33) is disposed in the truncatoconical needle tip (30, 35, 40, 45) at the level of which the injection holes (9) are disposed, so that when the valve (27, 55) opens the nozzle needle (1) is axially stabilized and the shaping of the injected jet is improved.

8 Claims, 2 Drawing Sheets

FUEL INJECTION VALVE FOR AN INTERNAL COMBUSTION ENGINE

The invention relates to a fuel injection valve according to the preamble of claim 1.

In fuel injection systems, fuel is injected under high pressure through a fuel injection valve into the combustion chamber of an internal combustion engine.

In DE 30 14 958 A1 a fuel injection valve is disclosed which has a nozzle body with a central guiding bore in which a nozzle needle is carried. The nozzle body is configured as a perforated nozzle. The axial movement of the nozzle needle opens the valve, which is formed by the sealing edge of the nozzle needle and the valve seat in the nozzle tip of the nozzle body. At the needle tip of the nozzle needle a step is created in order to prevent the valve seat diameter from being reduced due to wear.

When the valve opens, fuel flows into the nozzle tip and through the injection holes in the nozzle tip, so that the nozzle needle can perform movements aimed laterally of its axis caused by the fuel pressure and the flow of the fuel, resulting in an irregular injection into the combustion chamber of the internal combustion engine.

The task of the invention consists in reducing movements of the nozzle needle aimed radially to the nozzle needle axis occurring when the valve is opened and in improving the shape of the injected jet.

The task of the invention is accomplished by the features of the independent claims.

Advantageous embodiments of the invention are given in the subordinate claims.

In the invention a nozzle needle is guided in the central guiding bore of a nozzle body. The nozzle needle has a circumferential sealing edge which forms together with the conical valve seat of the nozzle body a closable and pressure-proof seal which controls by the axial movement of the nozzle needle the flow of fuel to the injection holes in the tip of the nozzle body. In the truncatoconical extremity of the nozzle needle a circumferential groove is provided at which, when the fuel injection valve opens, a pressure equalization is established by which a force acting radially on the nozzle needle is produced which opposes a radial deviation of the nozzle needle and thus guides it axially.

Advantageously, the groove is disposed at the level of the injection holes in the nozzle tip of the nozzle body, so that the shape of the injected jet is improved.

Preferred embodiments of the invention are further explained by the description of the figures.

Figure 1:
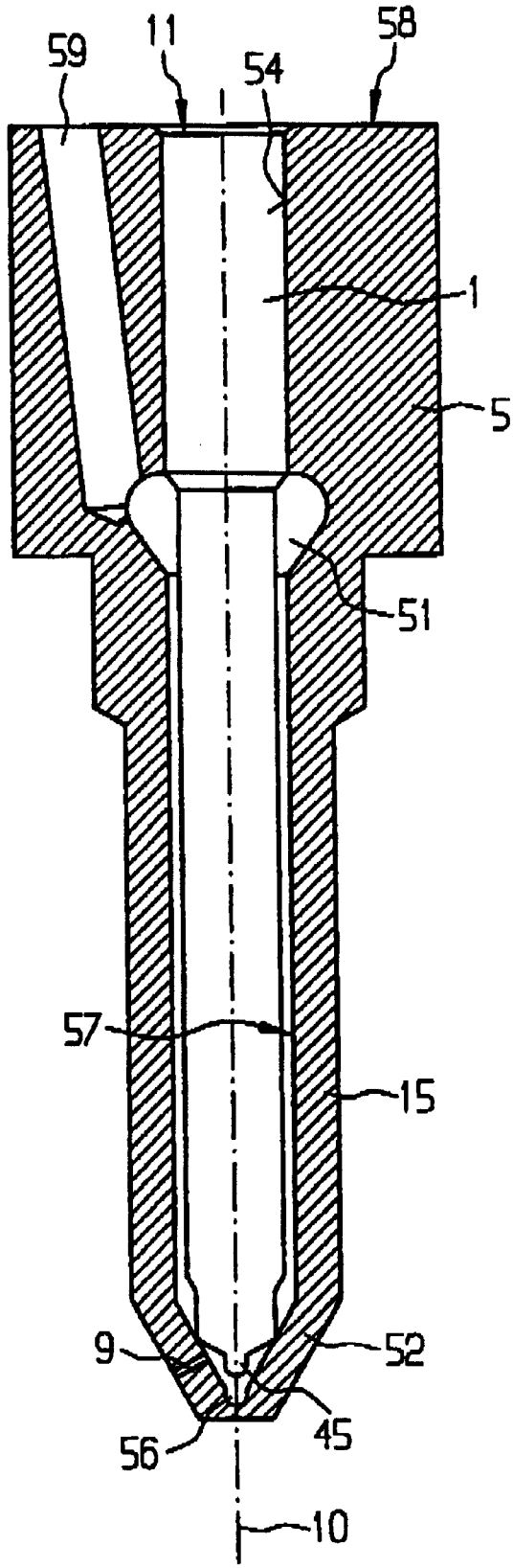
Figure 2:
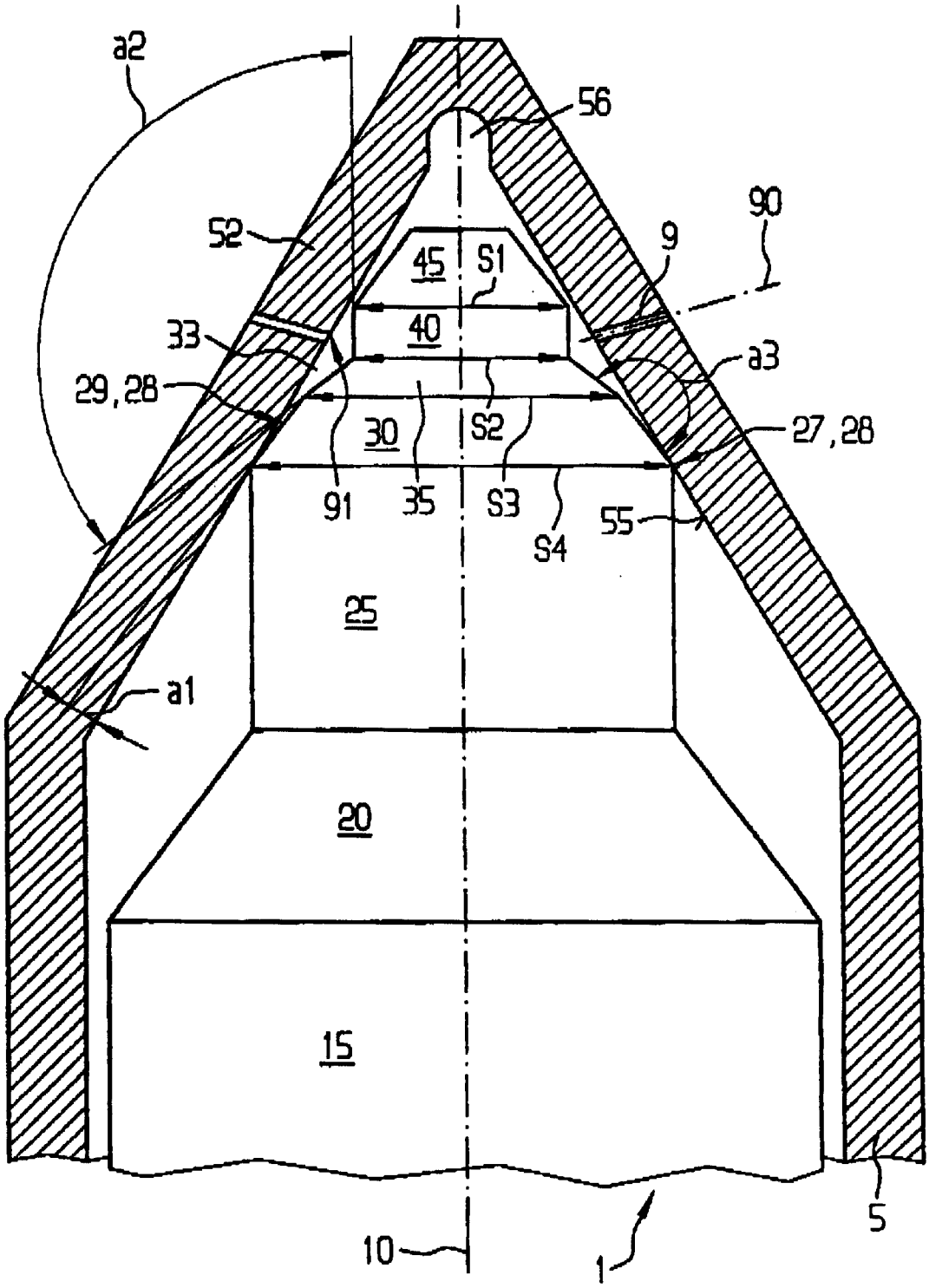

FIG. 1 is a longitudinal section through the nozzle body of a fuel injection valve with a nozzle needle, FIG. 2 a longitudinal section through the area of the tip of a nozzle body with a nozzle needle.

FIG. 1 shows a fuel injection valve in a longitudinal section through a substantially rotationally symmetrical nozzle body 5 in whose central guiding bore 54 a rotationally symmetrical nozzle needle 1 is axially guided. From the butt 58 of the nozzle body 5 the guiding bore 54 runs into a pressure chamber 51, a shaft bore 57 and a tapering valve seat 55 which terminates in a pocket 56. A delivery passage 59 is disposed laterally of the guiding bore 54 and leads into the pressure chamber 51.

The nozzle needle 1 is divided axially into body sections whose diameters diminish from the back 11 of the nozzle needle 1 to the end of the nozzle with the needle tip 45 of needle 1. Starting from the back end 11 the nozzle needle 1 has in the area of the guiding bore 54 approximately the diameter of the guiding bore and passes over preferably at the level of the pressure chamber 51 into a truncatoconical body section, followed by a preferably cylindrical needle shaft 15 of smaller diameter, a truncatoconical first sealing section 25 and the needle end which consists of a plurality of body sections described below.

FIG. 2 shows a more precise view of the area of the needle end and of the nozzle tip 52 from FIG. 1.

The needle end has a truncatoconical basic body shape tapering toward the nozzle tip 52, with a circumferential groove 33, and starting from the back end 11 of the nozzle needle 1 it is axially divided into:

- a truncatoconical second sealing section 30 with a circumferential sealing surface 29,
- a truncatoconical first groove section 35 whose surface encloses a greater angle with the longitudinal axis 10 of the fuel injection valve than the second sealing section 30,
- a preferably cylindrical second groove section 40, and
- the truncatoconical nozzle tip 45.

The first and second sealing sections 25 and 30 include at their transition a circumferential sealing edge 27 which, depending on the axial position of the nozzle needle 1,

- rests on the valve seat 55 of the nozzle body 5 and interrupts the flow of fuel to the injection holes 9 in the nozzle tip 52 of the nozzle body 5, or
- is lifted from the valve seat 55 and releases the flow of fuel to the injection holes 9.

Together with the valve seat 55 the sealing edge 27 can thus interrupt the flow of fuel; hereinafter the sealing edge 27 with the valve seat 55 shall be referred to as valve 27,55 which is opened or closed depending on the position of the nozzle needle 1.

In FIG. 2 the sealing edge 27 rests on the valve seat 55, and valve 27,55 is thus closed; the position of the nozzle needle 1 at which the valve 27,55 is closed is referred to as the closed position.

The valve 27,55 opens whenever the nozzle needle 1 is shifted toward its back end 11. Shortly after the valve 27,55 opens, fuel flows into the space between the needle end and the valve seat 55 and on through the injection holes 9 into the combustion chamber of an internal combustion engine.

While the nozzle needle 1 is open an equalization of pressure takes place at the groove 33 of the nozzle needle 1, and due to the fuel pressure and flow a force directed radially against its longitudinal axis 10 is exerted on the nozzle needle 1, which counteracts any radial deflection of the nozzle needle 1, so that the nozzle needle is radially stabilized and centered.

Therefore, just after valve 27,55 opens, a uniform shaping of the injection jet through all injection holes 9 is accomplished, which advantageously results in a combustion that is low in pollutants. The force acting radially against the needle 1 depends on the fuel pressure and increases as the fuel pressure increases.

By means of the groove 33, which radially stabilizes the nozzle needle 1, a complicated second guiding means in the shaft bore 57 for needle 1 can be dispensed with.

When valve 27,55 closes, the nozzle needle 1 strikes against the valve seat 55, thereby applying severe mechanical stress to the valve seat 55 and sealing edge 27. The sealing surface 29 forms with valve seat 55, when the needle 1 is in the closed position on the sealing edge 27, a first angle which is but slightly greater than 0 degrees. When the sealing edge 27 strikes against the valve seat 55 the sealing surface 29 contacts the valve seat 55 due to the resilient deformation of the nozzle body 5 and needle 1, thereby enlarging the impact area and thus advantageously reducing the material stress. The sealing edge 27 and the sealing surface 29 are referred to hereinafter as sealing area 28. Due to the small first angle a1, the area of damage between the nozzle tip 52 and the needle's end is advantageously reduced.

The first and the second groove sections 35 and 40 define by their surface the groove 33 and enclose at their transition a second angle a2, which ranges preferably between 125 and 155 degrees.

When valve 27,55 is closed, and preferably also when valve 27,55 is fully open, with the maximum excursion of nozzle needle 1, the axes 90 of the injection holes 9 lead into groove 33.

Preferably, the edge 91 of the orifice of the injection hole 9 on the inside of the nozzle body 5 is situated at the level of the second groove section 40, whenever the nozzle needle 1 is in its closed position, and preferably also when the nozzle needle 1 is at its maximum excursion.

The transition between the needle tip 45 and the second groove section 40 has a cross section with a first diameter s1.

The ratio between the first and third diameters s1 and s3 ranges between 0.5 and 0.7.

The transition between the first groove section 35 and the second groove section 40 has a cross section with a second diameter s2.

The ratio between the first and second diameters s1 and s2 is approximately 1.

The transition between the second sealing section 30 and the first sealing section 25 has a cross section with a fourth diameter s4.

The ratio between the third and fourth diameters s3 and s4 ranges between 0.7 and 0.8.

The transitions between the body sections with the cross sections of the first, second, third and fourth diameters s1, s2, s3, s4, are preferably rounded, which simplifies manufacture and advantageously reduces the turbulence of the flowing fuel.

The second sealing section 30 forms with the first groove section 35, at the transition to the third diameter s3, a third angle a3 ranging between 190 and 210 degrees, thereby advantageously reducing the turbulence of the flowing fuel.

In an additional embodiment, the second sealing section 30 can be merged at the third angle a3, in which case the first angle a1>>1 degree. The sealing area 28 of the nozzle needle 1 then consists only of the sealing edge 27. The second angle a2 is adapted accordingly.

The nozzle body 5 is preferably in the form of a seat hole nozzle in which the injection holes 9 are situated in the nozzle tip 52 near the valve 27,55.

What is claimed is:

1. Fuel injection valve with a nozzle needle (1) which is guided in a central guiding bore (54) of a nozzle body (5) and has only one circumferential sealing area (28) including a sealing surface (29) and a sealing edge 27 which forms together with a valve seat (55) of the nozzle body (5) a valve (27,55) which is opened or closed depending on the position of the nozzle needle (1) and controls fuel flow to at least one injection hole (9) in a nozzle tip (52) of the nozzle body (5), characterized in that the nozzle needle (1) has a circumferential groove (33) between the sealing area (28) and a needle tip (45) of the nozzle needle (1), the groove (33) is defined by first and the second groove sections (35,40) of the nozzle needle (1) enclosing a second angle (a2) which lies in the range between 125 and 155 degrees, and a hole axis (90) of the injection hole (9) enters into the groove (33) whenever the sealing edge (27) of the nozzle needle (1) lies on the valve seat (55).

2. Fuel injection valve according to claim 1, characterized in that an edge (91) of the injection hole (9) on an inside of the nozzle body (5) confronts the second groove section (40) when the nozzle needle (1) is fully extended.

3. Fuel injection valve according to claim 1, characterized in that the hole axis (90) of the injection hole (9) enters into the second groove section (40) whenever the sealing edge (27) of the nozzle needle (1) rests on the valve seat (55).

4. Fuel injection valve according to claim 1, characterized in that a first transition between the needle tip (45) and the second groove section (40) has a cross section with a first diameter (s1), a third transition between the first groove section 35 and the sealing surface 29 has a cross section with a third diameter (s3), and a ratio between the first and the third diameters (s1,s3) ranges between 0.5 and 0.7.

5. Fuel injection valve according to claim 4, characterized in that a second transition between the first groove section (35) and the second groove section (40) has a cross section with a second diameter (s2) and a ratio between the first and the second diameters (s1,s2) is approximately 1.

6. Fuel injection valve according to claim 5, characterized in that a fourth transition between the sealing surface 29 and a first sealing section (25) has a cross section with a fourth diameter (s4), and a ratio between the third and the fourth diameter (s3,s4) ranges between 0.7 and 0.8.

7. Fuel injection valve according to claim 6, characterized in that the transitions at the first, second, third and the fourth diameters s1, s2, s3, s4 are rounded.

8. Fuel injection valve according to claim 4, characterized in that the sealing surface (29) encloses with the first groove section (35) at the transition to the third diameter (s3) a third angle (a3) which ranges between 190 and 210 degrees.

* * * * *